US006032725A

United States Patent [19]

Marschke et al.

[11] Patent Number: 6,032,725

[45] Date of Patent: Mar. 7, 2000

[54] ROTARY STEAM JOINT AND VALVE ASSEMBLY

[75] Inventors: Carl M. Marschke, Phillips; Todd M. McCarthy, Jr., Rio, both of Wis.

[73] Assignee: Marquip, Inc., Phillips, Wis.

[21] Appl. No.: 09/089,124

[22] Filed: Jun. 2, 1998

[51] Int. Cl.[7] ..... F28D 11/02

[52] U.S. Cl. ..... 165/90; 165/89; 492/46; 34/124

[58] Field of Search ..... 165/90, 89, DIG. 158; 492/46; 34/124

[56] References Cited

U.S. PATENT DOCUMENTS

| | | | |
|---|---|---|---|
| 1,823,813 | 9/1931 | Wurster | 165/90 X |
| 3,625,280 | 12/1971 | Fritz | 165/90 |
| 4,965,920 | 10/1990 | Smith | 165/90 X |
| 4,991,276 | 2/1991 | Briemont | 165/90 |
| 5,230,169 | 7/1993 | Jaatinen et al. | 165/90 X |
| 5,533,569 | 7/1996 | Reibel et al. | 165/90 |
| 5,655,596 | 8/1997 | Zaoralek | 165/90 |
| 5,899,264 | 5/1999 | Marschke | 165/89 |

*Primary Examiner*—Christopher Atkinson
*Attorney, Agent, or Firm*—Andrus, Sceales, Starke & Sawall

[57] ABSTRACT

A rotary steam joint and valve assembly for a steam heated roll includes a non-rotatable, axially slidable sleeve journaled on one of the roll shaft ends and operable to selectively withdraw condensate which pools in the lower part of the roll when the roll is stopped or operating at low speed. At higher roll speeds, when condensate is more uniformly distributed circumferentially around the roll interior, the valve is operable to open all radial condensate return paths to the concentrate discharge port in the shaft end. Steam is supplied radially to the shaft end and the valve is constructed to permit steam flow in either position of the valve.

12 Claims, 4 Drawing Sheets

ROTARY STEAM JOINT AND VALVE ASSEMBLY

BACKGROUND OF THE INVENTION

The present invention pertains to an apparatus for heating a rotary cylindrical roll and, more particularly, to a rotary joint and valve assembly for supplying steam to and for handling the removal of condensate from a steam heated roll.

Rotary cylindrical drums and rolls are used in a wide variety of material treating applications. In one particularly common use, webs of material to be treated are wrapped around a heated rotary roll which transmits heat to the web traveling thereon. Steam is the most commonly used heating fluid and steam heated rolls are well known in the art. Steam is typically supplied and condensate water removed from the interior of the roll via axial bores in the roll shaft and utilizing rotary joints for the steam supply and siphon tubes for condensate withdrawal. The steam may be supplied to the entire open interior of the roll or may be directed to channels formed in the interior cylindrical wall of the roll. Condensate removal may be effected with a non-rotating siphon tube with an inlet positioned near the interior of the roll shell at the lowermost point of roll rotation, or with radially extending condensate removal tubes which extend from the roll shell to a common condensate outlet in the roll shaft.

At least two problems which are directly related to uneven roll heating and resultant thermal distortion have long plagued the industry. Condensate in the roll interior will accumulate by gravity flow in the lowermost region of the roll, except when the roll is turning at a high enough speed so that centrifugal force overcomes the force of gravity and the condensate is spread in a thin layer on the entire cylindrical interior of the drum, a condition sometimes referred to as "rimming". However, at low speed or when the roll is stopped, the condensate may pool to a depth sufficient to insulate the metal roll shell from direct contact by steam and, as a result, the lower portion of the roll shell will be much cooler than the remainder of the roll shell. The cooler portion of the roll shell will tend to bow inwardly with potentially serious consequences. For example, in a steam heated corrugating roll of the type used in the manufacture of single face corrugated paperboard, the bowing resulting from thermal distortion may cause the paper web to be cut by greatly varying nip forces when roll rotation is commenced.

In steam heated rolls, if the roll end walls (or end bells) are not maintained close to the operating temperature of the heated cylindrical drum wall, thermal distortion may result in roll shell separation from the end walls.

Another problem in steam heating systems for rolls is the inevitable presence of non-condensable gases in the steam system occurring, for example, from unavoidable air leakage and the like. If such non-condensable gases are not flushed from the system, they will diminish the rate of condensate formation and, therefore, the heat transfer capability of the steam. A flow-through system for supplying steam and utilizing steam pressure to return the condensate would allow the non-condensable gases to be flushed for removal outside the roll utilizing removal means, such as a flash tank, well known in the art.

It is also known that, in the construction of rotary steam joints, exposing joint assemblies to concentrated axial steam pressure can result in a potentially dangerous situation. On the other hand, controlling steam pressure such that it acts on a joint assembly in a radial direction would allow better use of pressure vessel design standards to avoid the axial pressure problems. Contamination of steam with small particulate impurities is also known to be a source of wear between relatively rotating metal surfaces in rotary steam joints.

Copending and commonly owned U.S. patent application Ser. No. 08/932,332, filed Sep. 17, 1997, now U.S. Pat. No. 5,899,264 discloses a steam heated roll including a cylindrical outer wall, a pair of enclosing end walls, a series of generally parallel and axially extending open-ended steam tubes in the cylindrical outer wall, an annular steam header which interconnects the open ends of the steam tubes on one end of the roll, and an annular condensate header which interconnects the open ends of the steam tubes on the other end of the roll. The roll also includes shaft ends which provide a steam inlet connection to one end wall, a plurality of radially extending stream transfer passages which are spaced circumferentially around the roll axis in one end wall to provide steam transfer paths between the steam inlet and the steam header, a condensate outlet connecting from the other end wall, and a plurality of radially extending condensate transfer passages which are spaced circumferentially around the roll axis in the other end wall to provide condensate transfer paths between the condensate header and the condensate outlet. A valve on one shaft end operates with the condensate outlet connection for blocking the flow of condensate through selected condensate transfer passages in a first valve position and for permitting the flow of condensate through all of the condensate transfer passages in a second valve position.

The present invention is directed primarily to improvements in a rotary steam joint and valve assembly for the steam heated roll disclosed in the above identified copending application.

SUMMARY OF THE INVENTION

The rotary steam joint and valve assembly of the present invention includes a radial steam supply passage in one of the shaft ends which defines the upstream end of the steam inlet. The same shaft end is also provided with a plurality of radial condensate outlet passages which define the downstream ends of the condensate outlet, each of the condensate outlet passages communicating with a condensate transfer passage in the end wall of the roll. A valve sleeve is journaled on the shaft end over the steam supply passage and the condensate outlet passages and is rotationally fixed to permit the shaft end to rotate therein, but is axially slidable on the shaft end. The sleeve has a radial steam supply port and a radial condensate discharge port. The sleeve is movable axially on the shaft end between a first axial position blocking condensate flow to the condensate discharge port through selected condensate outlet passages, and a second axial position permitting condensate flow to the discharge port through all of said condensate outlet passages. In both the first and second axial positions of the valve sleeve, steam flow from the steam supply port through the steam supply passage is unrestricted.

In the preferred embodiment, the radial condensate outlet passages are spaced circumferentially around the shaft end and correspond in number and in circumferential position to the condensate transfer passages in the end wall. The condensate discharge port includes a single opening which communicates with a single condensate outlet passage in the first axial position of the sleeve, and an annular circumferential condensate channel which communicates with all of the condensate outlet passages in the second axial position of the sleeve. The shaft end is provided with a plurality of axially extending condensate bores, each of which connects a condensate transfer passage and a condensate outlet passage.

In the preferred embodiment, the radial steam supply passage comprises a plurality of radial supply passages which are spaced circumferentially around the shaft end. The steam supply port includes an annular circumferential steam channel which communicates with all of the steam supply passages in both the first and second axial positions of the sleeve.

DETAILED DESCRIPTION OF THE INVENTION

The rotary joint and valve assembly of the present invention is shown as applied to a steam heated corrugating roll 10 of the type used in the manufacture of a single face corrugated paperboard web. Thus, the outer periphery of the cylindrical outer wall 11 of the roll is provided with a pattern of teeth or flutes 12 which, with a similar inter-engaging and counterrotating roll (not shown) form a nip in which a paper web is corrugated prior to being glued to a liner web to form the single face paperboard web, all in a manner well known in the art. It is also known in the art to heat the interior of the roll with steam to enhance the curing of the glue used to join the web components. The heated roll 10 of the present invention is constructed to alleviate the problems in prior art rolls discussed in the above identified copending application and, in particular, incorporates an improved rotary joint and condensate control valve.

Figure 7:
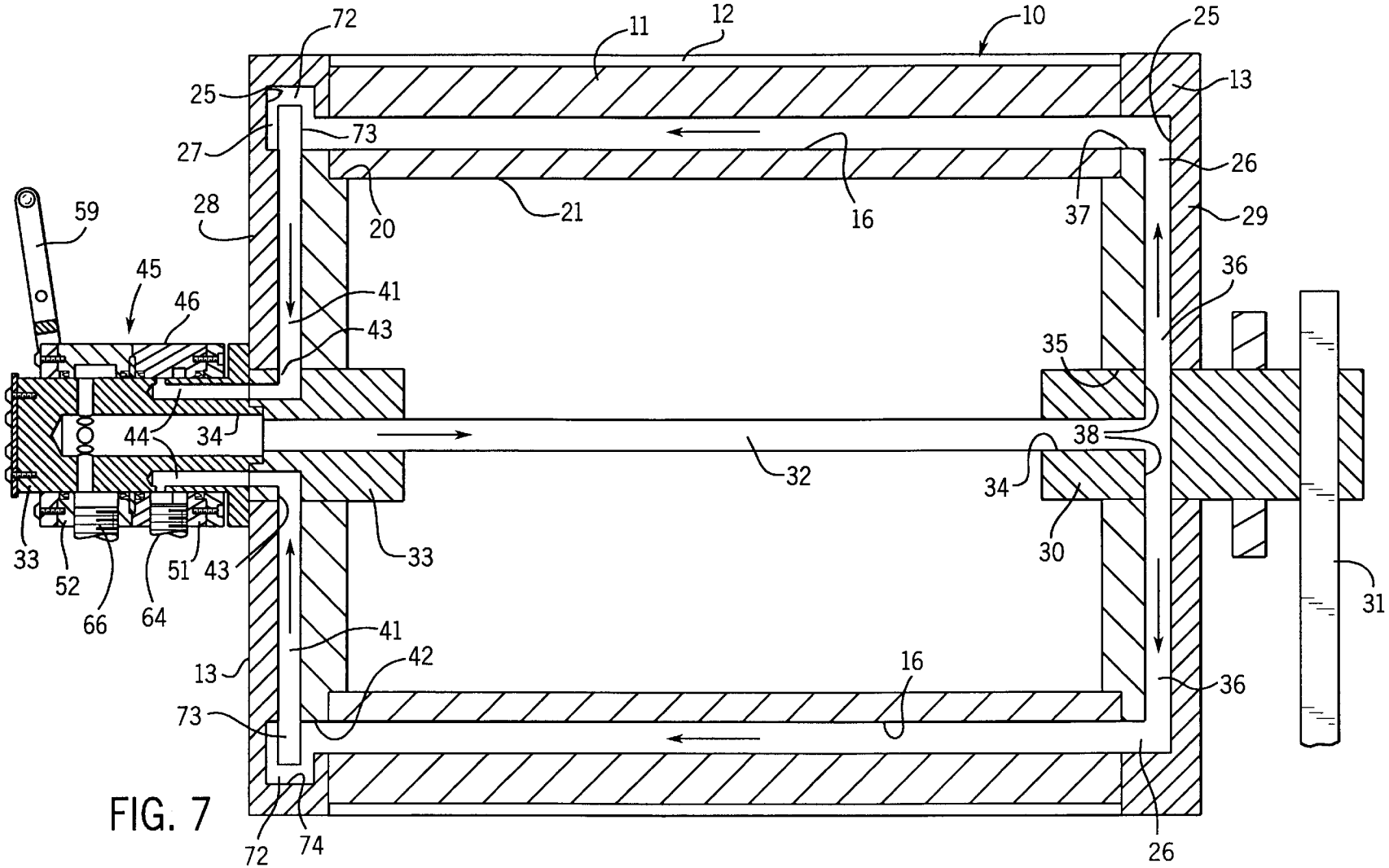
FIG. 7 is a schematic vertical section through the roll and valve assembly of FIG. 1 showing the overall steam and condensate flow paths.

Referring also to FIG. 7, the heavy cylindrical outer wall 11 of the roll is provided with a series of parallel and axially extending open-ended steam conduits 16 which are equally distributed circumferentially around the entire periphery of the wall. Each of the two end walls 13 is of a similar construction and made from relatively heavy plate stock. The end walls are preferably provided with cut-out or open sectors 14 divided by radially extending spokes 15. The inside face of the outer rim of each end wall 13 is provided with an annular shoulder 20 which, after assembly, extends into and fits closely with the inside cylindrical surface 21 of the outer wall 11. Each of the end walls 13 also includes a large annular groove 25. When the end walls 13 are attached to the cylindrical outer wall 11, the annular groove 25 is aligned with the open ends of the steam conduits 16. The large groove 25 in one end wall 13 forms a steam supply header 26 and the groove 25 in the other end wall comprises a condensate return header 27. Thus, steam supplied to the steam supply end wall 29 is distributed radially and uniformly to the steam header 26 (in a manner to be described), flows axially through the steam conduits 16, and the condensate flows (under the influence of the small differential between steam supply pressure and condensate return pressure) into the condensate header 27, and is returned radially through the condensate return end wall 28 for collection (also in a manner to be described).

A steam delivery tube 32 extends axially through the roll 10 between opposite stub shafts 30 and 33. The roll end walls 13 are welded or otherwise secured to the respective stub shafts for rotation therewith. One stub shaft 30 is attached to the steam supply end wall 29 and is rotatably supported on the machine frame 31 with a suitable bearing. The other stub shaft 33 on the opposite end of the roll is also supported on the machine frame 31 with a similar bearing. The steam delivery tube 32 interconnects stub shafts 30 and 33. The steam supply end wall 29 includes a central stub shaft opening 35 through which the stub shaft 30 extends. The end wall 29 is provided with a series of steam transfer bores 36 which are spaced circumferentially around the roll axis and extend radially through the spokes 15 and from the shaft opening 35 to the inner shoulder 37 of the steam header 26. The inner end of each steam transfer bore 36 is aligned with a radial steam port 38 drilled in the stub shaft 30 into a stub shaft bore 34. Steam supplied to the opposite stub shaft 33 travels along the steam delivery tube 32, into the stub shaft bore 34, through the steam ports 38 in the stub shaft, and radially outwardly along the steam transfer bores 36 in the spokes 15 in end wall 29 into the steam supply header 26.

Steam from the supply header 26 travels along the steam conduits 16 and condensate is collected in the condensate header 27 in the condensate return end wall 28 on the opposite end. In a manner similar to the steam supply end wall 29, the spokes 15 in the condensate return end wall 28 are provided with radially extending condensate transfer bores 41 which are spaced circumferentially around the roll axis. The condensate transfer bores 41 extend from bore openings in the annular inner shoulder 42 of the condensate header 27 to condensate ports 43 in the stub shaft 33. The stub shaft 33 is provided with a plurality of circumferentially spaced axial blind condensate bores 44 to receive the return flow of condensate from each of said condensate transfer bores 41 in the end wall 40. Thus, condensate collecting in the condensate header 27 flows radially inwardly through the condensate transfer bores 41 and condensate ports 43 into the blind bores 44, from which the continued flow is subject to the control of a valve 45 forming a part of a rotary steam joint 46 in accordance with the invention.

The condensate flow control valve 45 provides effective removal of condensate at low roll speeds or when the roll is stopped. If the roll is slowed or stopped, condensate which had been held by centrifugal force (i.e. rimming) against the radially outermost surfaces in the condensate path will tend to flow downwardly by gravity and pool in the lowermost portions of the condensate paths. Under these conditions and without the unique condensate control valve to be described, steam pressure may be inadequate to overcome the static head necessary to lift the condensate from the lowermost regions because steam and condensate flow will tend to follow the lower pressure paths in the upper regions of the steam/condensate flow path. As a result, pooled condensate in the lower region of the roll will tend to accumulate and insulate the outer wall 11 from the conduction of heat because water has poor heat conductivity as compared to steel. The remainder of the cylindrical outer wall of the roll remains preferentially heated to operating temperature. The insulated lower portion may bow inwardly as a result of thermal contraction. Upon re-start, the distortion may be so severe as to cut or tear the paperboard web being processed.

As a part of the rotary steam joint 46 and valve 45 assembly of the present invention, the stub shaft 33 is provided with a plurality of radial steam supply passages 47 which are equally spaced circumferentially around the shaft end and provide open communication between the outside surface of the stub shaft 33 and the axial bore 34 in the shaft. The stub shaft 33 is also provided with a plurality of radial condensate outlet passages 48 which provide open communication between the outside surface of the shaft and the axial condensate bores 44. Referring also to FIGS. 3–6, a generally cylindrical valve sleeve 50 is journaled on the OD of the stub shaft 33 and covers the radial steam supply passages 47 and the radial condensate outlet passages 48. As shown, the sleeve 50 is preferably comprised of a condensate sleeve portion 51 and a steam sleeve portion 52 which lie in direct abutting contact with one another. A pilot washer 53 is interposed between the abutting surfaces of the sleeve portions 51 and 52, and the washer also serves as a retainer for a pair of annular seals 54. The opposite ends of each of the sleeve portions 51 and 52 are similarly provided with annular seals 54 which are, respectively, held in place by a condensate side retaining ring 55 and a steam side retaining ring 56. The retaining rings 55 and 56 are attached to their respective sleeve portions 51 and 52 with machine screws 57. The sleeve portions 51 and 52 are secured together with long machine screws (not shown) which extend axially through aligned bores in the steam side retaining ring 56 and the steam sleeve portion 52 and into tapped holes in the condensate sleeve portion 51. The entire sleeve assembly 50 is axially movable on the stub shaft 33 by a valve operator 58. An operator arm 59 is pivotally mounted to a mounting bracket 60 connected to the machine frame 31. The arm 59 has an upper end connected to a fluid actuator 61 and a lower clevis end 62 pivotally attached to diametrically opposite sides of the steam side retaining ring 56. The valve operator mounting also holds the assembly against rotation.

Figure 1:
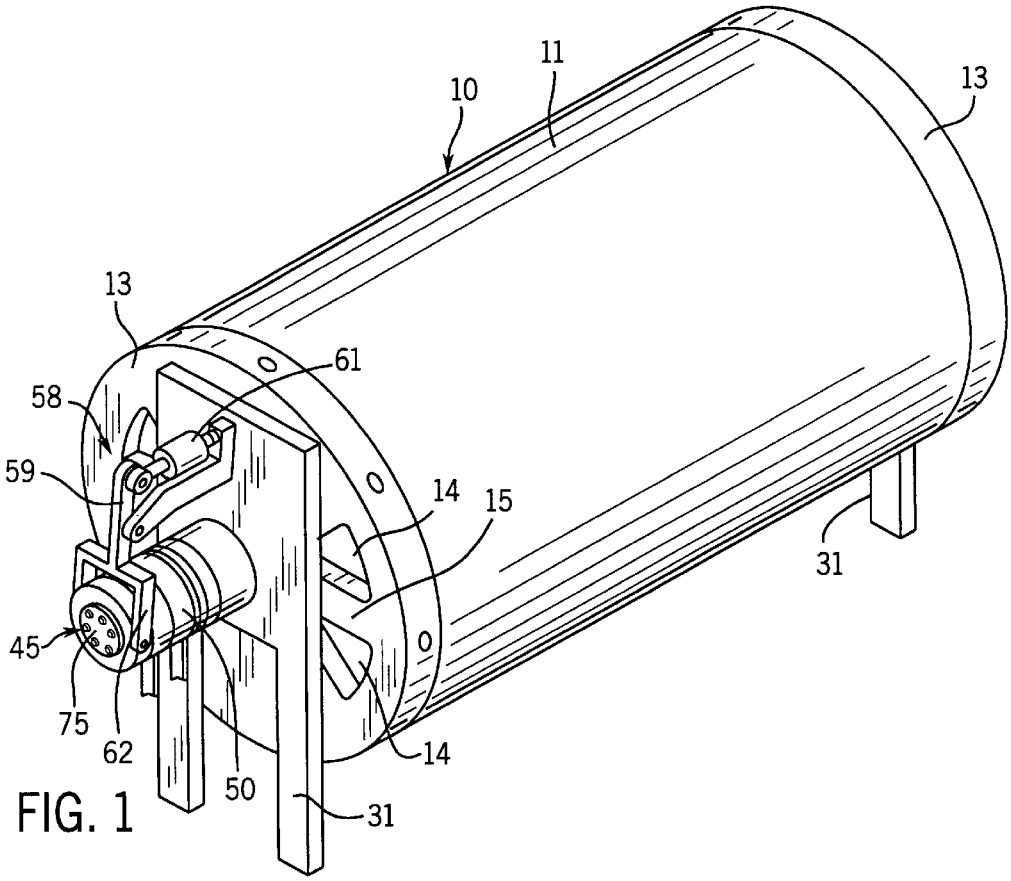
FIG. 1 is a perspective view of a rotatable heated roll utilizing a rotary steam joint and valve assembly of the present invention.
Figure 2:
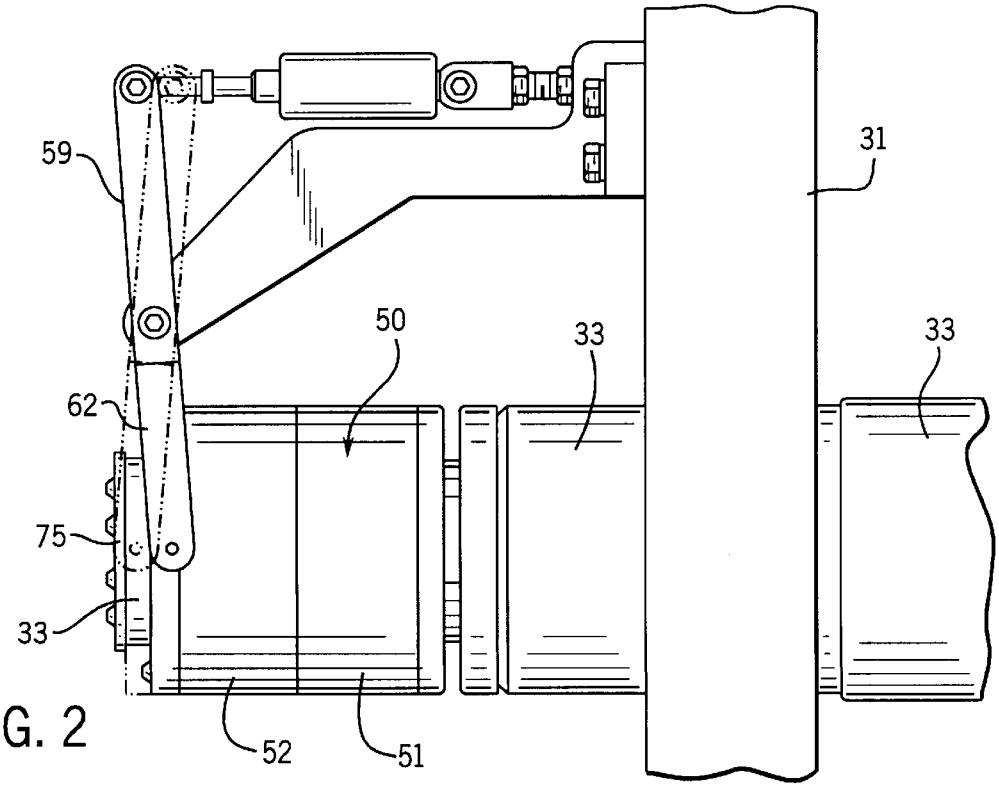
FIG. 2 is an enlarged side elevation view of the valve assembly shown in FIG. 1.
Figure 3:
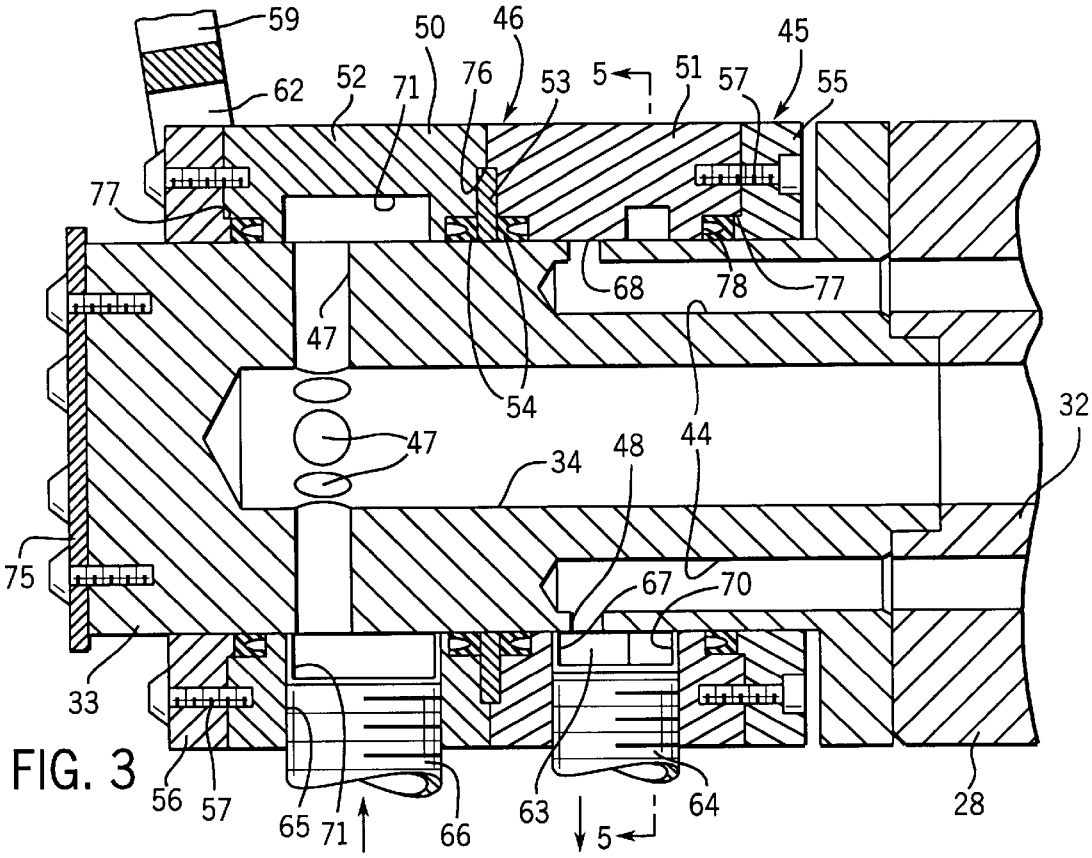
FIG. 3 is a vertical section through the axis of the valve assembly of FIG. 2 with the valve in the first position.

The bottom of the condensate sleeve portion 51 is provided with a radial condensate discharge port 63 which is suitably tapped for threaded connection of a condensate discharge pipe 64. In a similar manner, the bottom of the steam sleeve portion 52 is provided with a radial steam supply port 65 which is also tapped for receipt of the threaded end of a steam supply pipe 66. The upper end of the condensate discharge port 63 in the sleeve 50 includes a generally circular opening 67 which, when the sleeve is slid to its righthandmost position in FIG. 3, is aligned with the lowermost radial condensate outlet passage 48. In this position of the sleeve, the remaining condensate outlet passages 48 (7 in this embodiment) remain covered by the ID surface 68 of the condensate sleeve portion 51. Therefore, in this position, condensate flow to the valve 45 may only occur via the axial condensate bore 44 corresponding to the lowermost condensate outlet passage 48.

The circular opening 67 at the upper end of the condensate discharge port 63 opens into an annular circumferential condensate channel 70 which is formed in the ID surface of the sleeve portion 51. As the valve sleeve 50 is slid to its lefthandmost position shown in FIG. 4, by operation of the valve operator 58, the circumferential condensate channel 70 will be aligned with and open to all of the radial condensate outlet passages 48. In this second position of the valve sleeve, condensate flow is permitted into the valve via all eight of the axial condensate bores 44.

An annular circumferential steam channel 71 is formed in the steam sleeve portion 52 and is aligned with the radial steam supply port 65. Annular steam channel 71 is somewhat wider in the axial direction than annular condensate channel 70. The width of steam channel 71 permits open communication with all of the radial steam supply passages 47 in the stub shaft 33 in either the first or second axial positions of the sleeve 50. In other words, steam supply to the heated roll 10 may be maintained regardless of whether limited condensate return is permitted (right-hand position of the valve sleeve 50 in FIG. 3) or full return condensate flow is permitted (left-hand position of the valve sleeve in FIG. 4).

Referring again to FIG. 7, as the heated roll comes to a stop, the portion of the condensate return header 27, which is radially beyond the outermost portion of the steam conduits 16, defines a sump 72. In the lowermost (6 o'clock) position, the sump 72 is the lowest point in the condensate return path and the point to which all condensate draining by gravity will tend to flow. With all but the lowermost of the condensate return paths closed by the valve sleeve 50 in the right-hand first position, the condensate pooling in the sump 72 will preferentially be returned under the influence of the differential in steam supply pressure and condensate return pressure via the vertically oriented condensate transfer bore 41 in the 6 o'clock position, its corresponding blind axial condensate bore 44 and the condensate flow path through the valve 45 described above. To assure that as much condensate as practical is extracted from the sump 72, each of the condensate transfer bores 41 includes a radially extending standoff 73 which extends from the annular inner shoulder 42 of the header 27 to a point closely spaced from the annular outer surface 74 (which forms the lowermost surface of the sump 72).

The entire valve sleeve 50, comprising sleeve portions 50 and 51 and retaining rings 55 and 56, is made of a high leaded tin-bronze alloy which provides some substantial benefits in the operation of the valve. The high lead content of the alloy acts as a bearing lubricant and, therefore, eliminates the need to use a high temperature grease or similar lubricant. In addition, the high lead content of the sleeve alloy tends to pickup abrasive contaminant particles which embed themselves in the surface of the alloy such that abrasive wear is reduced. One particularly well suited alloy is UNS Alloy No. C93200 comprising 83% copper, 6.3% tin, 7% lead and 3% zinc. The stub shaft 33 is made of steel and, preferably, is covered on its exterior bearing surface and interior surfaces with an electroless nickel plating.

The composite construction of the sleeve 50, including sleeve portions 51 and 52 and retaining rings 55 and 56, preferably includes a piloted construction to assure cylindrical concentricity of the ID bearing surface. As previously indicated, the abutting faces of the sleeve portions 51 and 52 enclose the pilot washer 53 in aligned annular recesses 76. Each of the retaining rings 55 and 56 has an annular shoulder 77 which is piloted in an annular recess 78 in one of the sleeve portions 51 or 52. The counter bores 78 also receive the annular seals 54, as do similar counter bores on the opposite axial end of each sleeve portion, which seals 54 are separated by the pilot washer 53.

Figure 4:
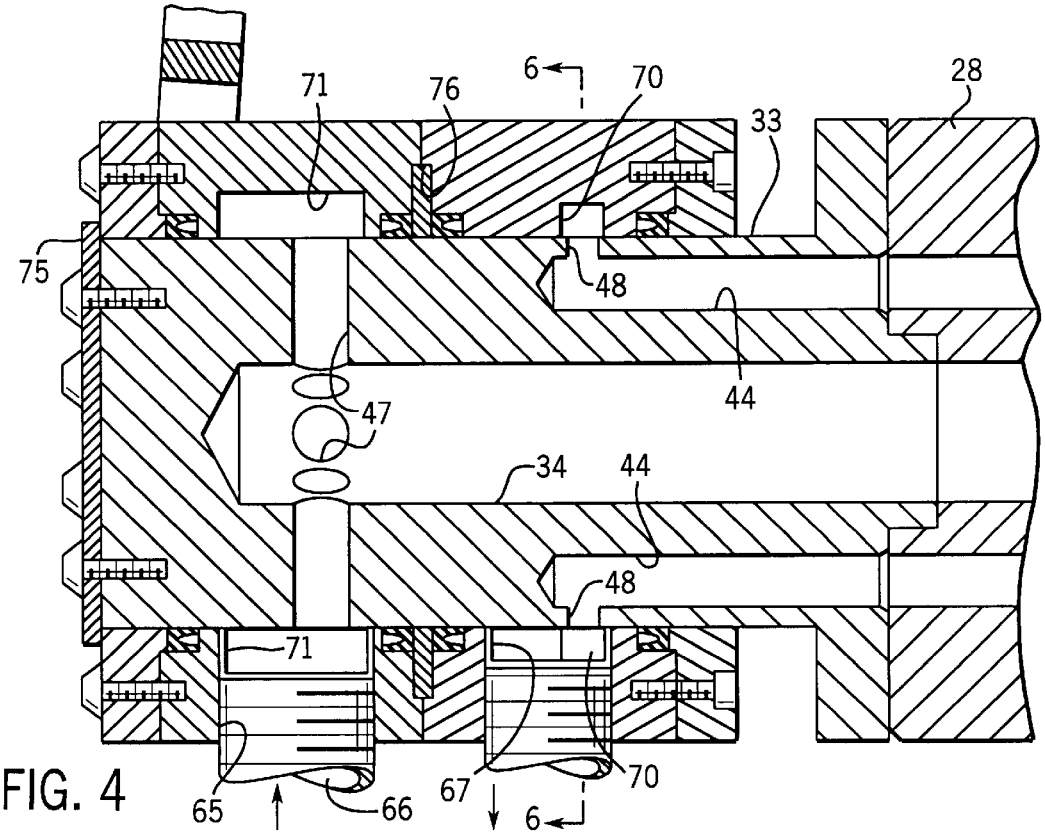
FIG. 4 is a vertical section through the axis of the valve assembly of FIG. 2 with the valve in the second position.
Figure 5:
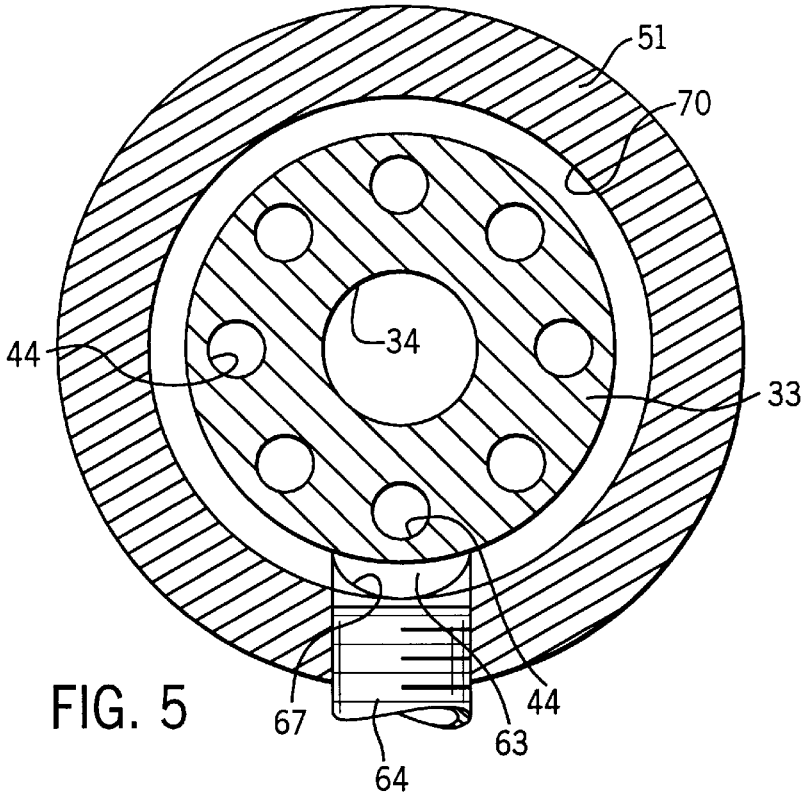
FIG. 5 is a vertical section taken on line 5—5 of FIG. 3.
Figure 6:
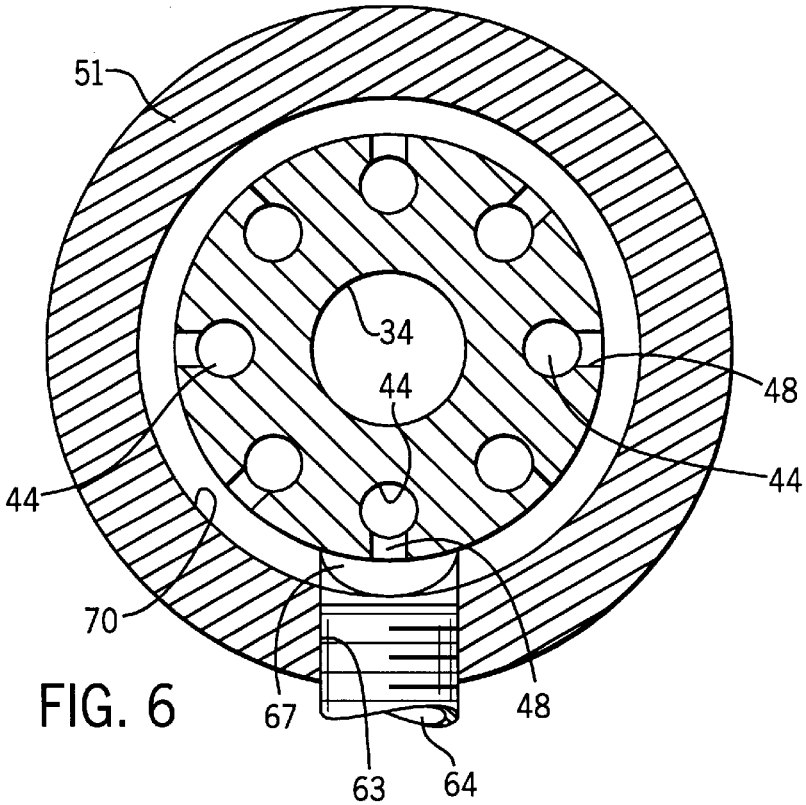
FIG. 6 is a vertical section taken on line 6—6 of FIG. 4.

As is best seen in FIGS. 3 and 4, the end of the stub shaft 33 has an oversize stop plate 75 attached to the axially outer end. The plate 75 acts as a stop to prevent movement of the sleeve 50 beyond the FIG. 4 second position.

We claim:

1. A rotary steam joint and valve assembly for a steam heated roll, said roll having a cylindrical outer wall, a pair of enclosing end walls, a roll shaft attached to the end walls and supporting the roll for rotation therewith, a series of generally parallel and axially extending open-ended steam conduits in the cylindrical outer wall, an annular steam header interconnecting the open ends of the conduits on one end of the roll, and an annular condensate header interconnecting the open ends of the conduits on the other end of the roll, a steam inlet in one end of the shaft communicating with one end wall, a plurality of radially extending steam transfer passages spaced circumferentially around the roll axis adjacent said one end wall and providing steam transfer paths between said steam inlet and the steam header, a condensate outlet in said one shaft end communicating with the other end wall, a plurality of radially extending condensate transfer passages spaced circumferentially around the roll axis adjacent the other end wall and providing condensate transfer paths between the condensate header and said condensate outlet, said assembly comprising:

a radial steam supply passage in said one shaft end defining the upstream end of said steam inlet;

a plurality of radial condensate outlet passages in said shaft end defining the downstream ends of said condensate outlet, each of said outlet passages communicating with a condensate transfer passage;

a valve sleeve journaled on said shaft end over said supply passage and outlet passages, said sleeve rotationally fixed to permit shaft end rotation therein and axially slidable on said shaft end, said sleeve having a radial steam supply port and a radial condensate discharge port; and, said sleeve having a first axial position blocking condensate flow to said discharge port through selected condensate outlet passages and a second axial position permitting condensate flow to said discharge port through all of said condensate outlet passages.

2. The apparatus as set forth in claim 1 wherein steam flow from said supply port through the steam supply passage is permitted in both said first and second axial positions of the sleeve.

3. The apparatus as set forth in claim 1 wherein:

said radial condensate outlet passages are spaced circumferentially around the shaft end and correspond in number and in circumferential position to the condensate transfer passages in the end wall; and, said condensate discharge port includes a single opening communicating with a single condensate outlet passage in the first axial position of the sleeve, and an annular circumferential condensate channel communicating with all of said condensate outlet passages in the second axial position of the sleeve.

4. The apparatus as set forth in claim 3 including a plurality of axially extending condensate bores in said shaft end, each bore connecting a condensate transfer passage and a condensate outlet passage.

5. The apparatus as set forth in claim 1 including an actuator operative to move said valve sleeve between said first and second positions.

6. The apparatus as set forth in claim 1 wherein said radial steam supply passage comprises a plurality of radial supply passages spaced circumferentially around the shaft end, and said steam supply port includes an annular circumferential steam channel communicating with all of said steam supply passages in both said first and second axial positions of the sleeve.

7. A rotary joint and valve assembly for a rotating shaft of a cylindrical roll having an outer surface adapted to receive a fluid medium for treating material in contact therewith, said assembly comprising:

a rotatable shaft end attached to an positioned axially outside the roll for rotation therewith;

a plurality of circumferentially spaced axial bores in said shaft end providing first fluid communication paths with respective circumferentially spaced portions of said roll surface;

a plurality of radial passages in said shaft end connecting the outside surface of the shaft end with said spaced axial bores;

an annular sleeve journaled on the outside surface of said shaft end over said radial passages, said sleeve fixed against rotation to permit shaft end rotation therein and axially slidable on said shaft end;

said sleeve having a first radial port extending through the sleeve to provide operative fluid communication with said radial passages from the outside of the sleeve; and, said sleeve having a first axial position blocking fluid communication between said radial port and first selected radial passages and a second axial position permitting fluid communication between said radial port and second selected radial passages.

8. The apparatus as set forth in claim 7 including:

an axial central bore in said shaft end providing a second fluid communication path with said portions of the roll surface;

a radial connection in said shaft end connecting the outside surface of the shaft end with said central bore; and, said sleeve overlying said radial connection and having a second radial port therethrough to provide fluid communication with said radial connection from the outside of the sleeve.

9. The apparatus as set forth in claim 8 wherein said second radial port provides fluid communication with said radial connection in both said first and second sleeve portions.

10. The apparatus as set forth in claim 9 wherein the fluid medium is supplied to the roll via said second fluid communication path and returned via said first communication paths.

11. The apparatus as set forth in claim 7 wherein the shaft end is made of steel and the sleeve is made of an alloy having a soft lubricating metal content.

12. The apparatus as set forth in claim 11 wherein said alloy comprises a highly leaded tin-bronze alloy.

* * * * *